United States Patent [19]

Hunt

[11] Patent Number: 4,588,083

[45] Date of Patent: May 13, 1986

[54] GARDEN HOSE STORAGE CONTAINER

[75] Inventor: Clifford L. Hunt, 5631 Kensington, El Paso, Tex. 79924

[73] Assignee: Clifford L. Hunt, El Paso, Tex.

[21] Appl. No.: 455,255

[22] Filed: Jan. 3, 1983

[51] Int. Cl.[4] ..... B65D 85/04

[52] U.S. Cl. ..... 206/389; 220/327; 242/86; 248/75; 248/79

[58] Field of Search ..... 206/389, 303; 242/86; 248/89, 75, 79; 220/327

[56] References Cited

U.S. PATENT DOCUMENTS

| | | | |
|---|---|---|---|
| 1,284,022 | 11/1918 | Wright | 248/89 |
| 1,532,177 | 4/1925 | Gist | 248/89 |
| 1,942,388 | 1/1934 | Ash | 242/86 |
| 2,300,243 | 10/1942 | Zierden | 242/86 |
| 2,334,141 | 11/1943 | Zierden | 248/75 |
| 2,871,057 | 1/1959 | Bernyk | 248/89 |
| 4,101,029 | 7/1978 | Feinberg et al. | 220/327 |
| 4,330,005 | 5/1982 | Kjarsgaard | 242/86 |

*Primary Examiner*—William T. Dixson, Jr.

[57] ABSTRACT

This invention is a storage container for a garden hose coiled therewithin, a removable top cover, and a means to lock and seal the cover on the container.

1 Claim, 2 Drawing Figures

Fig. 1
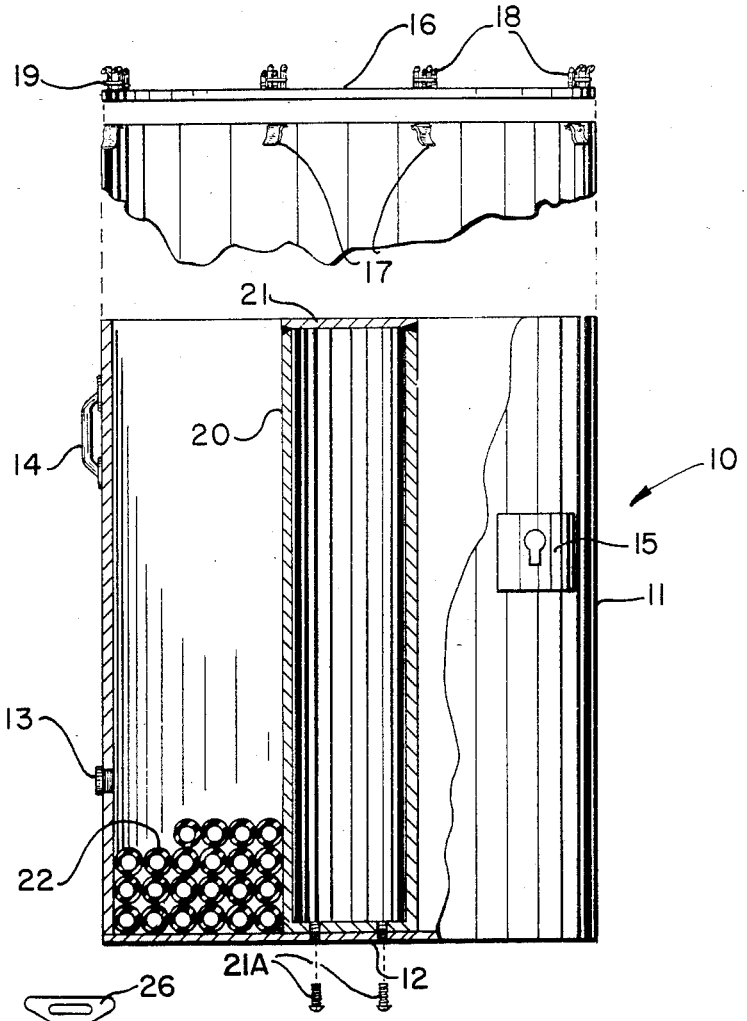
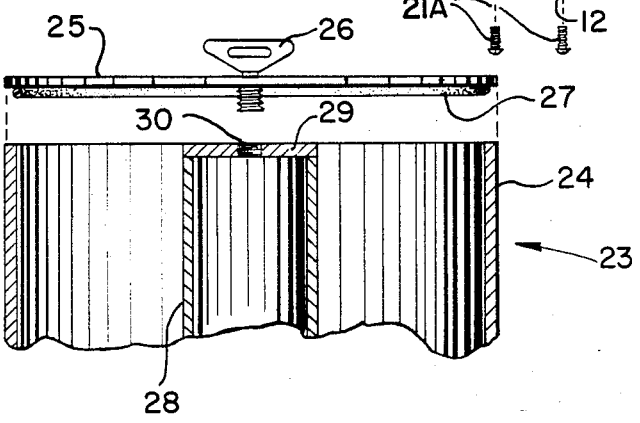
Fig. 2

GARDEN HOSE STORAGE CONTAINER

This invention relates generally to gardening accessories. More specifically, it relates to storage devices for garden hoses.

It is well known to most gardeners that, when a garden hose is intended to be stored away for a long period of time, such as over the winter, it is best to coil it up into a neat circle and put it away, instead of leaving it thrown loose in a pile on a storage area floor, where it gets underfoot, and is subject to becoming damaged. However, even a neatly coiled hose, if left exposed is in danger of damage by paints or other chemicals spilling thereupon, or being cut by sharp objects or chewed up by a dog, so that this situation is, accordingly, in need of an improvement.

Therefore, it is a principal object of the present invention to provide a closable container, inside which a garden hose may be stored away in a safe manner, by being protected from any corrosive chemicals, sharp objects or plain neglect.

Another object is to provide a garden hose storage container, which holds the hose in an isolated condition, and which permits the hose being retained in a minimal size of space, without the possibility of accidentally becoming uncoiled, and getting in the way of other activity in a storage area.

Other objects are to provide a garden hose storage container, which is simple in design, inexpensive to manufacture, rugged in construction, easy to use, and efficient in operation.

These, and other objects, will be readily evident, upon a study of the following specification, and the accompanying drawing, wherein:

FIG. 1 is a vertical sectional view of the garden hose container, showing a portion broken away, and FIG. 2 is a fragmentary vertical sectional view, shown partly in elevation, and showing a modified design of lock for the cover thereof.

Rererring now to the drawing in greater detail, the reference numeral 10 represents a storage container for a garden hose which is coiled up therewith, and is then enclosed by a removable cover or lid.

The container is cylindrical in shape, and includes a cylindrical side wall 11 and a circular bottom wall 12, for forming a storage space therewithin, that is accessible from an opened top end of the container. An opening along the side wall is fitted with a valve plug 13, through which any excessive air pressure or moisture may be outwardly discharged from the closed container, in order to prevent such excesses from deteriorating or rotting a rubber hose material.

A handle 14, along the side wall, provides convenience for carrying the container by hand, when transporting the hose between the garden and a storage area. A fitting 15, also affixed on an outer side of the side wall, includes a bayonette slot for the purpose of receiving a hook or the like, when it is wished for the container to be supported from a wall in a storage area.

The cover 16, for closing the open, upper end of the container, is securable thereto by means of a plurality of spaced-apart hooks 17, around the upper edge of the container, being engaged by locking latches 18 around the edge of the cover, the hooks and latches forming lock sets 19.

Inside the center of the container, a cylindrical, hollow post 20 is secured, so that the hose 22 may be coiled therearound. The post includes a bottom wall, which is affixed to the container bottom wall by means of screws 21A. A circular top wall 21 is welded upon the top of the post, so as to seal the interior thereof.

In operative use, a garden hose 22 is coiled inside the container, within the circular space around the post.

Referring now to FIG. 2, a modified design of cover-locking means is shown, wherein the container 23 includes side wall 24, upon the top of which a cover 25 is removably placed. In this design, a wing bolt 26 is fitted through a central hole in the cover. An underside of the cover is padded with a flat gasket 27, for resting against an upper end of the central post 28, where the top wall 29 of the post includes a threaded hole 30 for being engaged by the wing bolt. Thus, the single wing bolt and threaded hole replace the above described plurality of lock sets, for locking the cover on the container in order to seal the same.

While various changes may be made in the detail construction, it is understood that such changes will be within the spirit and scope of the present invention, as is defined by the appended claims.

What I claim as new, is:

1. A storage container assembly for a garden hose, comprising, in combination, a cylindrical container and a circular cover for closing an upper open end of said container, a cylindrical post in the center of said container for said hose to be coiled therearound, and means to lock and seal said cover upon said container, said means comprising a plurality of spaced-apart hooks around the upper edge of said container, and a like plurality of spaced-apart locking latches around the edge of said cover for engagement together; a convenient carrying handle and a valve plug on a side of said container; and a fitting affixed on said container side for receiving a wall-mounted hook.

* * * * *